United States Patent [19]

Maisel

[11] 3,962,676

[45] June 8, 1976

[54] CONTROL SYSTEM FOR OHMIC LOADS, PREFERABLY SIGNAL LAMPS IN A ROAD TRAFFIC SYSTEM

[75] Inventor: Horst Maisel, Munich, Germany

[73] Assignee: Siemens Aktiengesellschaft, Berlin & Munich, Germany

[22] Filed: July 23, 1973

[21] Appl. No.: 381,903

[30] Foreign Application Priority Data

Aug. 4, 1972 Germany ..... 2238521

[52] U.S. Cl. ..... 340/41 R; 340/46; 340/253 R

[51] Int. Cl.[2] ..... G08G 1/00

[58] Field of Search ..... 340/41, 46, 251, 253 R, 340/256, 253 B

[56] References Cited

UNITED STATES PATENTS

| | | | |
|---|---|---|---|
| 2,166,721 | 7/1939 | Jeffers | 340/46 |
| 3,311,779 | 3/1967 | Hartkorn, Jr. | 340/251 |
| 3,596,238 | 7/1971 | Siklos | 340/46 |
| 3,596,239 | 7/1971 | Hata | 340/46 |

*Primary Examiner*—Marshall M. Curtis
*Attorney, Agent, or Firm*—Hill, Gross, Simpson, Van Santen, Steadman, Chiara & Simpson

[57] ABSTRACT

A control system for ohmic loads, particularly signal lamps of a traffic regulating system in response to periodic test pulses supplied under normal operating conditions of the ohmic loads in which an evaluation relay having an inherent delay and including an actuating winding is adapted to be energized by the discharge of a capacitor, the actuating winding forming a part of a series circuit including such capacitor and a diode with said capacitor being adapted to be charged from a power supply which forms a part of a second series circuit which also includes such capacitor as well as a further diode, and transistors for controlling the respective series circuits in response to said periodic test pulses, with the duration of the charge period of such capacitor being less than the inherent delay of said relay.

2 Claims, 2 Drawing Figures

CONTROL SYSTEM FOR OHMIC LOADS, PREFERABLY SIGNAL LAMPS IN A ROAD TRAFFIC SYSTEM

BACKGROUND OF THE INVENTION

The invention is directed to a control system for ohmic loads, preferably signal lamps in a road traffic system, in which a frequency generator controls test switches associated with the individual ohmic loads, with the test switches being operatively connected at the output side to an evaluation switch, operative to control the supply of current to such evaluation switch.

The control of the "red" or "stop" lights of traffic signal systems is of particular importance with respect to safety, as substantially incorrect operation of such lights can result in serious accidents. Consequently, it is not sufficient to merely monitor such "red" lights as to their individual correct functioning, but to provide an adequate safety factor in the overall control of the system and to effect suitable control thereof in the event of an improper functioning of one of the "red" lights. It is known to provide test switches with a test frequency and to use the absence of the test frequency as a criterion for the occurrence of faults. As transistors are generally utilized as test switches, there is always the possibility and risk that a short circuit may take place whereby the operating voltage falsely indicates the presence of the test frequency, and thus the operating fault remains undetected. In order to prevent this situation, it has heretofore been suggested to provide a transformer as a decoupling member between the test switch and the evalution switch, but such transformer has a technically high production cost and in addition the size thereof presents a disadvantage, particularly in view of general miniaturization techniques being employed at the present time.

The invention therefore is directed to the problem of providing a circuit in which the effect of operational faults are always reflected by a desired actuation of the evaluation switch, i.e. always toward the safe side, and in which the circuit arrangement is smaller in size and can be technically produced with less effort than previously described circuitry.

BRIEF SUMMARY OF THE INVENTION

In accordance with the invention, the desired results are achieved, in a control system for ohmic loads by a circuit in which the output of a frequency generator, extended over test switches associated with the individual ohmic loads, controls the supply of current, over a capacitor, to an evaluation switch, further switching means being provided whereby current flowing over the capacitor in a particular direction, preferably the discharging direction, energizes the evaluation switch. It is advantageous in effecting a saving and power cost, to provide push-pull switching means for the control of the capacitor. Two amplifiers, preferably transistors may be employed which are disposed in respective current paths, one for effecting charging and the other discharging of the capacitor, respective crystal diodes being disposed at the output side of the capacitor in the respective paths and oppositely poled. The respective amplifiers are adapted to be controlled by the test frequency supplied over the test switches and adapted to alternately render the respective amplifiers conductive and nonconductive, whereby conduction of one amplifier and simultaneous blocking of the other will provide a charging current across the capacitor while the conductive condition of the other amplifier and corresponding blocking condition of the first amplifier will provide a discharge path for such capacitor, with the respective diodes isolating their associated circuits from one another.

BRIEF DESCRIPTION OF THE DRAWINGS

In the drawings wherein like reference characters indicate like or corresponding parts.

DETAILED DESCRIPTION OF THE INVENTION

Figure 1:
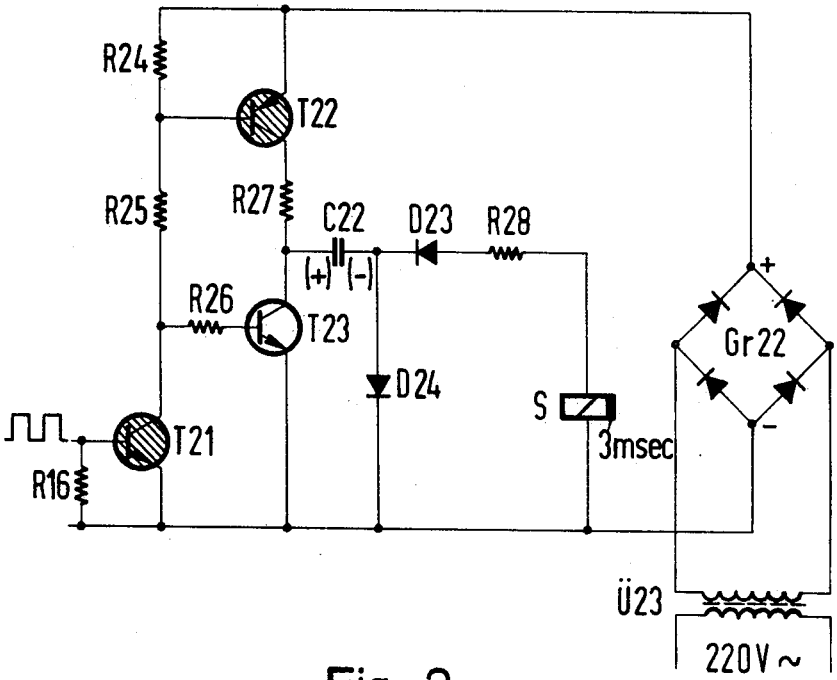
FIG. 1 is a circuit diagram illustrating a preferred circuit.

Referring to FIG. 1, which illustrates a preferred circuit of the invention, as subsequently described in detail, the evaluation switch S is adapted to be maintained in an energized condition in response to the presence of test pulses at the base of a transistor T21, which base is connected to resistance R16. The test pulses are adapted to be suitably supplied from a test generator or the like, and, for example, may comprise a rectangular voltage of 9kHz. The presence or absence of the test pulses at the transistor T21 is dependent upon a suitable monitoring circuit, the details of which form no part of the present invention, which is so designed that as long as the respective ohmic loads, for example signal lamps of a traffic regulating system, are properly operated, the monitoring circuit will conduct the test pulses to the transistor T21, but in the event of an operational failure with respect to one of the ohmic loads, the test pulse path to the transistor T21 will be open, whereby such transistor will not receive the test pulses, resulting in de-energization of the evaluation relay S to provide the desired control function.

In the arrangement of FIG. 1, the switch T21 receives its collector voltage over resistances 1 R25 full wave crystal diode bridge GR22 and transformer Ü23, the primary of which is connected directly to the operating or supply voltage. Two additional transistors T22 and T23 are employed which with the capacitor C22, diodes D23 and D24 form two current paths for the capacitor C22, resistances R24 and R28 being included merely as voltage separators and current limitors. One such current path is adapted to extend from the diode bridge over transistor T22 resistor R27, capacitor C22, and diode D24 to the opposite side of the rectifier bridge. Thus when the transistors T21 and T22 are conductive the capacitor C22 will be charged, with the polarity being as indicated. Upon the termination of an impulse at the transistor T21, the latter as well as the transistor T22 will return to blocking condition, and simultaneously therewith the transistor T23 will become conductive. Conductive transistor T23 now completes a discharge loop containing transistor T23, capacitor C22, diode D23, resistance R28 and evaluation switch S. Thus, in the presence of the test signal on a base of the transistor T21, the evaluation switch S will be continuously attracted and remain attracted during the zero passages of the supply voltage as a result of its slow release characteristic of more than 3msec.

The capacitor C22 blocks the direct operating voltage on the transistors with respect to the evaluation switch S, whereby the transistors T21 or T22 respectively cannot maintain the evaluation switch falsely attracted if a short circuit should occur. Thus, even with a combined short circuit of the transistor T22 and capacitor C22 the diode D24 would short circuit the evaluation switch S and prevent its responding.

Figure 2:
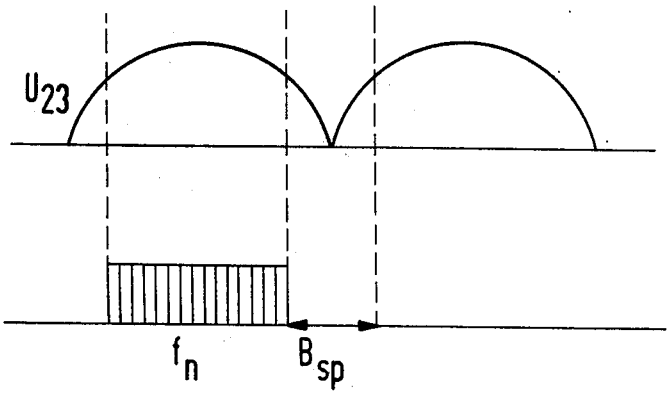
FIG. 2 is a diagram illustrating the operating voltage and effective impulses acting on the evaluation switch.

Likewise, as illustrated in FIG. 1, the switch T21 is nonconductive for impulses in the range of the zero passages of the rectified operating current U23 (designated Bsp in FIG. 2) as such transistor in such case receives insufficient collector voltage. Any disturbing impulses therefore can have no effect. Consequently, the switch T21 is controlled by the test generator TG in the operating range of the positive waves of the supply voltage.

Having thus described my invention it will be obvious that minor modifications might be suggested by those versed in the art, it should be understood that I wish to embody within the scope of the patent warranted hereon all such modifications as reasonably and properly come within the scope of my contribution to the art.

I claim as my invention:

1. A control system for ohmic loads, particularly signal lamps of a traffic regulating system, in response to periodic test pulses supplied under normal operating conditions of the ohmic loads, comprising an evaluation relay having an inherent delay and including an actuating winding, a series circuit comprising a capacitor; a first diode, a unidirectional power supply and a first transistor, operative when said first transistor is conductive to charge said capacitor from said power supply, a second series circuit comprising said capacitor, a second diode, a second transistor, and said actuating winding, operative when said second transistor is conductive to discharge said capacitor through said actuating winding, and means operatively supplying said test pulses to said transistors for effecting alternate conduction of said transistors whereby the charge and discharge of said capacitor is controlled by said test pulses the duration of the charge period being less than the inherent delay of said relay.

2. A control system according to claim 1, wherein said first transistor operatively connects one side of said capacitor to one side of said power supply, and said first diode operatively connects the other side of said capacitor to the other side of said power supply, said second transistor being connected in parallel with the capacitor and said series connected first diode, and said actuating winding and said second diode being connected in parallel with said first diode.

* * * * *